United States Patent [19]

Naumann

[11] Patent Number: 4,665,719

[45] Date of Patent: May 19, 1987

[54] CIRCULATING THREAD GUIDES

[75] Inventor: Rolf Naumann, Muhlheim a.M., Fed. Rep. of Germany

[73] Assignee: Karl Mayer Textilmaschinenfabrik GmbH, Obertshausen, Fed. Rep. of Germany

[21] Appl. No.: 894,563

[22] Filed: Aug. 8, 1986

[30] Foreign Application Priority Data

Aug. 16, 1985 [DE] Fed. Rep. of Germany ..... 3529287

[51] Int. Cl.[4] ..... D04B 23/06

[52] U.S. Cl. ..... 66/84 A; 66/203; 66/125 R

[58] Field of Search ..... 66/125, 84 A, 85 A, 66/203

[56] References Cited

FOREIGN PATENT DOCUMENTS 290176 10/1913 Fed. Rep. of Germany ..... 66/84

OTHER PUBLICATIONS

Paling, D. F., "Warp Knitting Technology", Harlquin Press, London, 1952, pp. 201–210

*Primary Examiner*—Ronald Feldbaum

*Attorney, Agent, or Firm*—Omri M. Behr

[57] ABSTRACT

There is provided a lapping arrangement with circulating thread guides for a warp knitting machine. The arrangement has carriers for the thread guides. A transport arrangement moves the carriers in a guide means comprising two parallel segments connected by two turning segments. In the location of the parallel segments the transport arrangement comprises two forwarding helices in whose helical thread ride rollers which are attached to the carriers. In this way, a precise positioning of the thread guides is possible.

14 Claims, 8 Drawing Figures

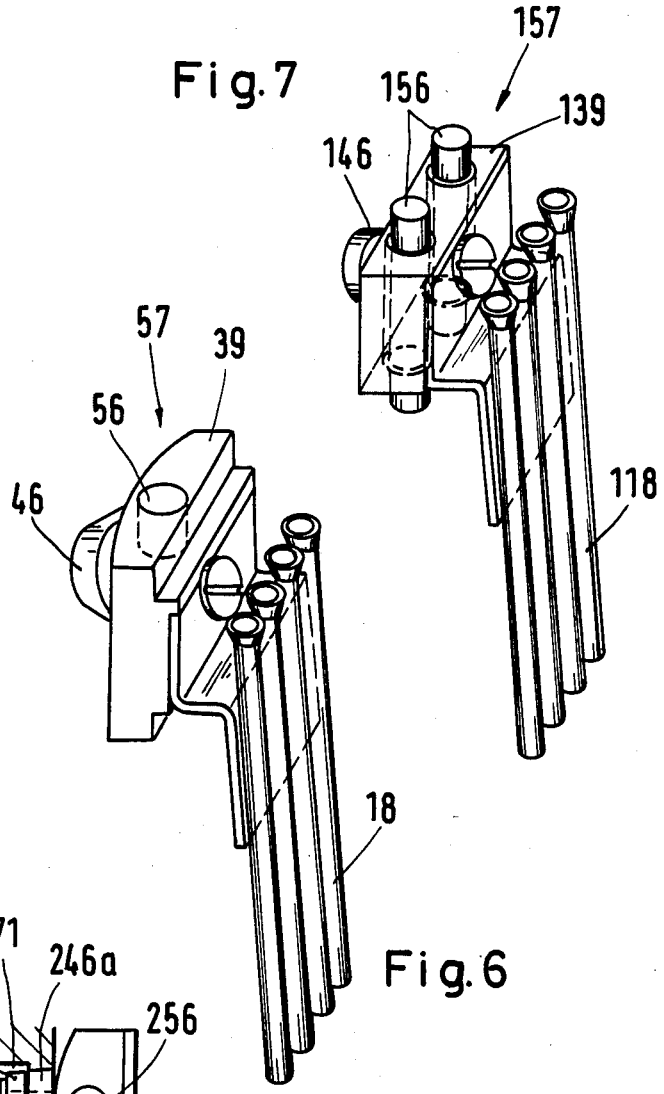
Fig. 7
Fig. 6
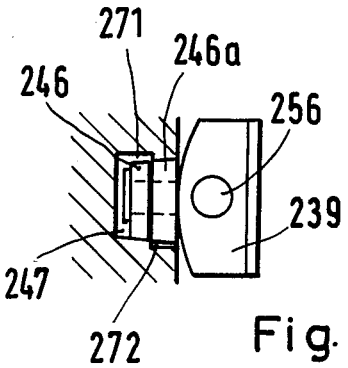
Fig. 8

CIRCULATING THREAD GUIDES

BACKGROUND OF THE INVENTION

The present invention relates to a laying arrangement employing circulating thread guides for a warp knitting machine wherein the guides are mounted singly or in groups on carriers which are displaceable and are guided by means of a transport arrangement, upon one of two parallel segments and two turning segments connecting said parallel segments.

Warp knitting machines of this type have been known for over 100 years and are designated as Milanese machines. They make it possible to produce goods with warp threads running diagonally.

A known arrangement of this type is disclosed in British Pat. No. 410391. In this arrangement the carriers comprise guide-supporting leads having separating pieces attached to both sides thereof. These leads run on guide rails by means of hooks formed in the leads. There are provided first combs with which the position of these carriers can be fixed, and alternatively thereto, axially displaceable second combs by the aid of which the carriers can obtain a lapping displacement. This alternating activation of the combs requires a certain amount of play. Thus, it is not possible to obtain an adequately precise guiding and therefore, no certain grip of the thread guides. In addition thereto it must be considered that during the running of the machine this play increases since the carriers, under the influence of the diagonally running warp threads are subject to a sidewards tension so that during the lifting motion of the combs, a frictional drag develops. For this reason exactness of separation is also missing since the separation means are worn down in the course of time.

An older arrangement is also known from U.S. Pat. No. 582,589, which which utilizes holes in an endless band as thread guides. These holes, however, have an exactly predetermined separation. Unfortunately it is not possible to move these guides through passages between the needles as is possible with thread guides. Furthermore, if the band breaks, for example even with respect to one bore therein, the entire band must be renewed which requires the tedious effort of rethreading of all of the threads.

Accordingly there is a need for a lapping arrangement of the heretofore described type wherein the circulating thread guides may be positioned as desired with greater precision. This task is solved by the present invention in providing a forwarding helix in the location of the parallel segments, into whose threads, rollers attached to the carriers may interact.

SUMMARY OF THE INVENTION

In accordance with the illustrative embodiments demonstrating features and advantages of the present invention, there is provided a thread laying arrangement for a warp knitting machine, comprising a transport arrangement, a track and a plurality of circulating carriers. Each carrier has at least one thread guide and at least one roller. The track has two parallel segments for slidably supporting the circulating carriers and two turning segments connected between and on opposite ends of the parallel segments. The transport arrangement has a pair of helical driving threads, each positioned adjacent a corresponding one of the parallel segments for driving the circulating carriers.

This leads to a particularly simple construction. Both of the helical driving threads can be mounted in a single mounting block. The forwarding helical driving threads may be driven from the main shaft, for example, by means of a reduction gear. In the simplest case this may run continuously.

In a futher embodiment of this invention, each carrier has on its upper side a portion of a pin coupling. The transport arrangement in the region of the turning segments has a turning drive. The other part of the pin coupling is mounted on a lifting element at the turning segments, so that when the lifting element is lowered, the pin coupling is brought into action and in this position the carrier is caused to change direction through turning.

Such a pin coupling can also be provided with rather small carriers and does not influence the guiding in the parallel segments. The turning and lifting drive of the lifting elements can be readily provided.

It is particularly desirable to form the pin coupling through a bore in the carrier and a pin in the lifting element. The boring can be entirely accomodated in the guiding paths.

Alternatively, the pin coupling may comprise two pins on the carrier which additionally are guided in at least one guide path. In ths way, the coupling pins are also used as guiding element.

BRIEF DESCRIPTION OF THE DRAWINGS

The invention may be illustrated in the drawings as follows:

FIG. 6 is a perspective view of the carrier of FIG. 1 with thread guides.

FIG. 7 is a perspective view of a carrier with thread guides which is an alternate to that of FIG. 6.

FIG. 8 is a plan view of a carrier which may be employed on the machine of FIG. 1.

DETAILED DESCRIPTION OF THE PREFERRED EMBODIMENTS

Figure 1:
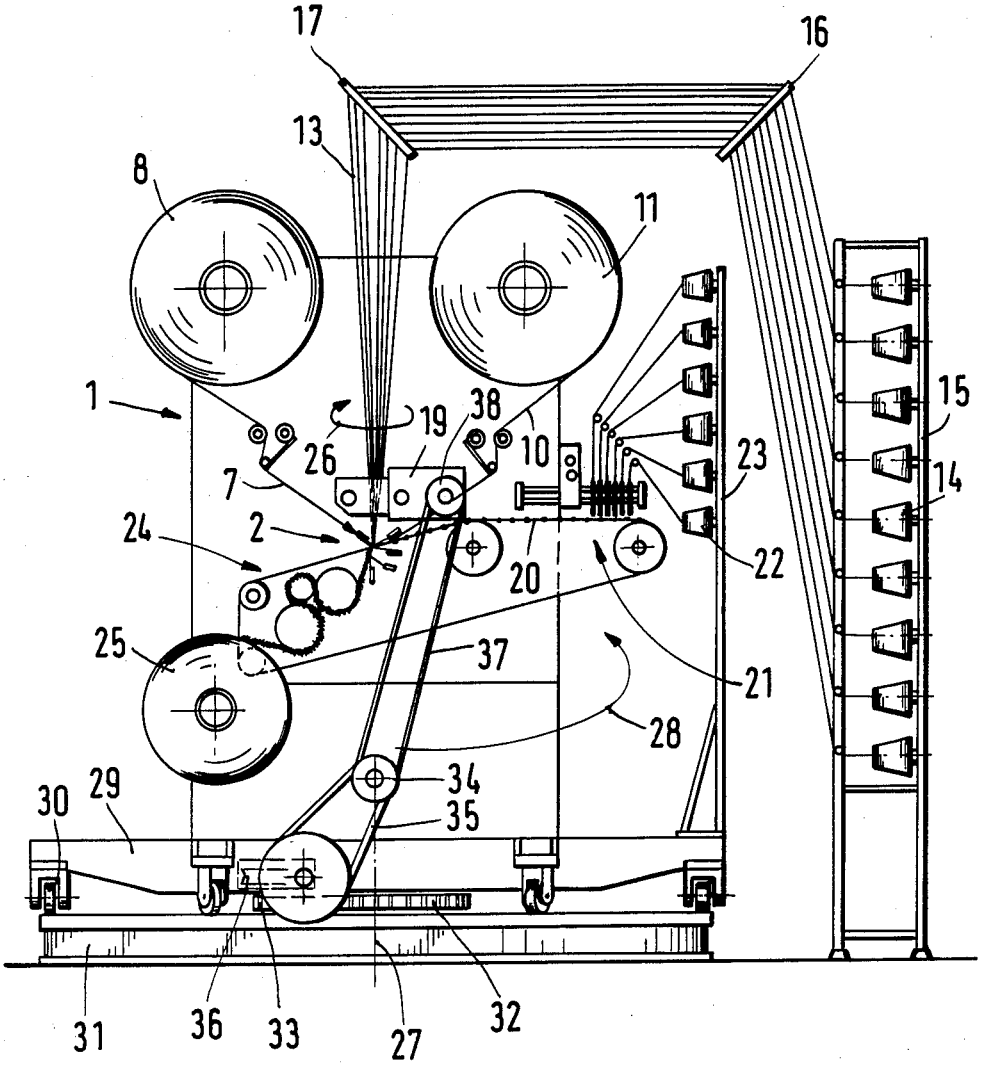
FIG. 1 is a side elevational view of a warp knitting machine of the present invention showing the novel lapping arrangement.
Figure 2:
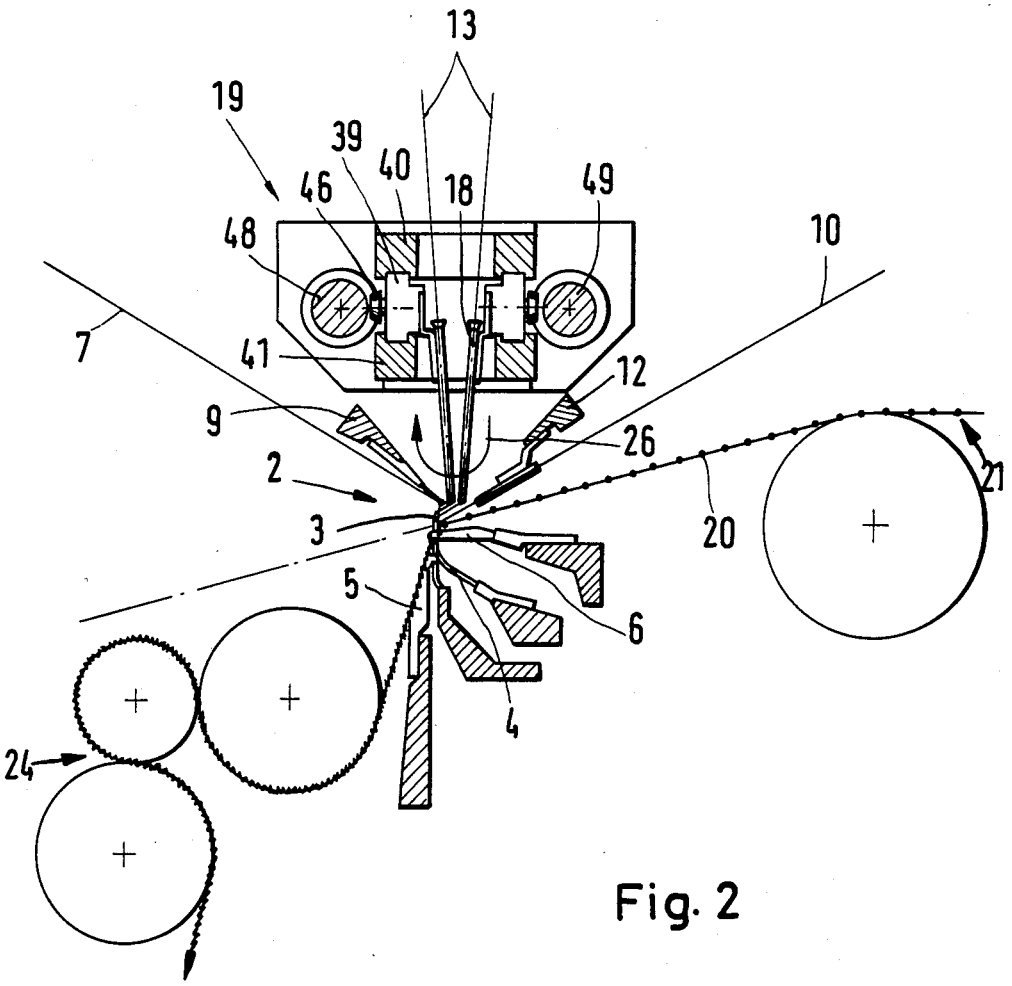
FIG. 2 is a cross sectional view of the working area of the machine of FIG. 1.

As illustrated in FIG. 1, the warp knitting machine comprises a frame 1 having a working area generally designated as 2 which is illustrated in greater detail in FIG. 2. This area 2 comprises needles 3 with sliders 4, knock over sinkers 5 and stitch cone sinkers 6. Each reciprocate in the usual fashion to to knit stitches. In the working area 2 the following thread system is operated:

1. The first warp thread 7 is led from the warp beam 8 over the thread guides of a first guide bar 9.

2. A second warp thread 10 runs from warp beam 11 over the thread guides of a second guide bar 12. Bars 9 and 12 can reciprocate by performing swinging and shogging motions for well known purposes.

3. Third warp threads 13 run from the spools 14 of a fixed creel 15 over the thread guiding arrangements 16 and 17, comprising eyelet plates or rings. Arrangements 16 and 17 feed threads 13 to the circulating thread guides 18 of the lapping arrangement 19, as will be described more fully hereainafter.

4. Weft threads 20 are forwarded through a magazine weft thread arrangement 21 of a known type from spools 22 on creel 23.

5. A triple-roller take-off arrangement 24 feeding a rolling-up arrangement 25 are provided after the working area 2.

The direction of movement of thread guides 18 in the lapping arrangement 19 is indicated by the direction of directional arrow 26 (FIG. 1) as will be discussed in detail below. The frame 1 and the creel 23 are rotatable in an opposite direction about a vertical axis 27 in the direction of arrow 28. In order to achieve this rotation, rollers 30 are provided to turntable 29 which may roll on base plate 31. This base plate 31 carries a fixed gear wheel 32 into which a bevel gear 33 on turntable 29 protrudes. This bevel gear 33 is driven from main shaft 34 over a tooth belt drive 35 and a tooth gear drive 36. The latter can also be provided as a switching drive.

The main shaft 34 is further connected over a tooth belt drive 37 with a drive wheel 38 of the lapping arrangement 19. The rotational speed of the frame 1 is so provided that after a single circuit of the thread guide 18, the frame 1 has also gone through a full circuit. This insures that the warp thread 13 does not become entangled.

The circulating thread guides 18 are formed as pipes and a group of them are illustrated attached to the carriers 39. The carriers 39 run in a pair of guide paths 40 and 41 set over each other which comprise two parallel segments 42 and 43 (FIGS. 2 and 5) as well as the end segments 44 and 45 connecting them. Guide paths 40 and 41 have two pairs of parallel channel-like tracks shaped to engage the edges of carriers 39 and allow them to slide along the length of paths 40, 41. Paths 40 and 41 are joined together at end segments 44 and 45. Segments 44 and 45 are similar to the just-mentioned straight guide paths, but have a curved centerline to allow turning of carriers 39. Also the upper portions of end segments 44 and 45 have an opening to allow insertion of the pin coupling means to be described presently.

Rotatably mounted on the inside of each carrier 39, is a roller 46 (FIG. 2) which runs in the helical driving threads 47 of the forwarding helices 48 and 49. In a preferred manner, the carriers 39 are led into guide paths 40, 41, which are positioned one on top of the other. The rollers 46 are positioned between the guide paths 40, 41 and the carriers 39. This gives rise to an exceedingly secure guiding for the thread guides 18 since the carriers 39 are supported in three neighboring positions. Specifically, carriers 39 are held in both of the guide paths 40, 41 as well as in the helical threads 47. It is thus possible to utilize rather small carriers. The distance between the guide paths 40, 41 can be small. Thus, it is possible to provide a rather compact construction for the lapping arrangement.

It is preferred that the rollers 46 have a conical circumferential surface and thus interact favorably with the angled sides of the threads 47. In this manner, the rollers 46 can fit themselves better to the cross-section of the thread 47. The resulting pressure against the surfaces is rather small.

Figure 3:
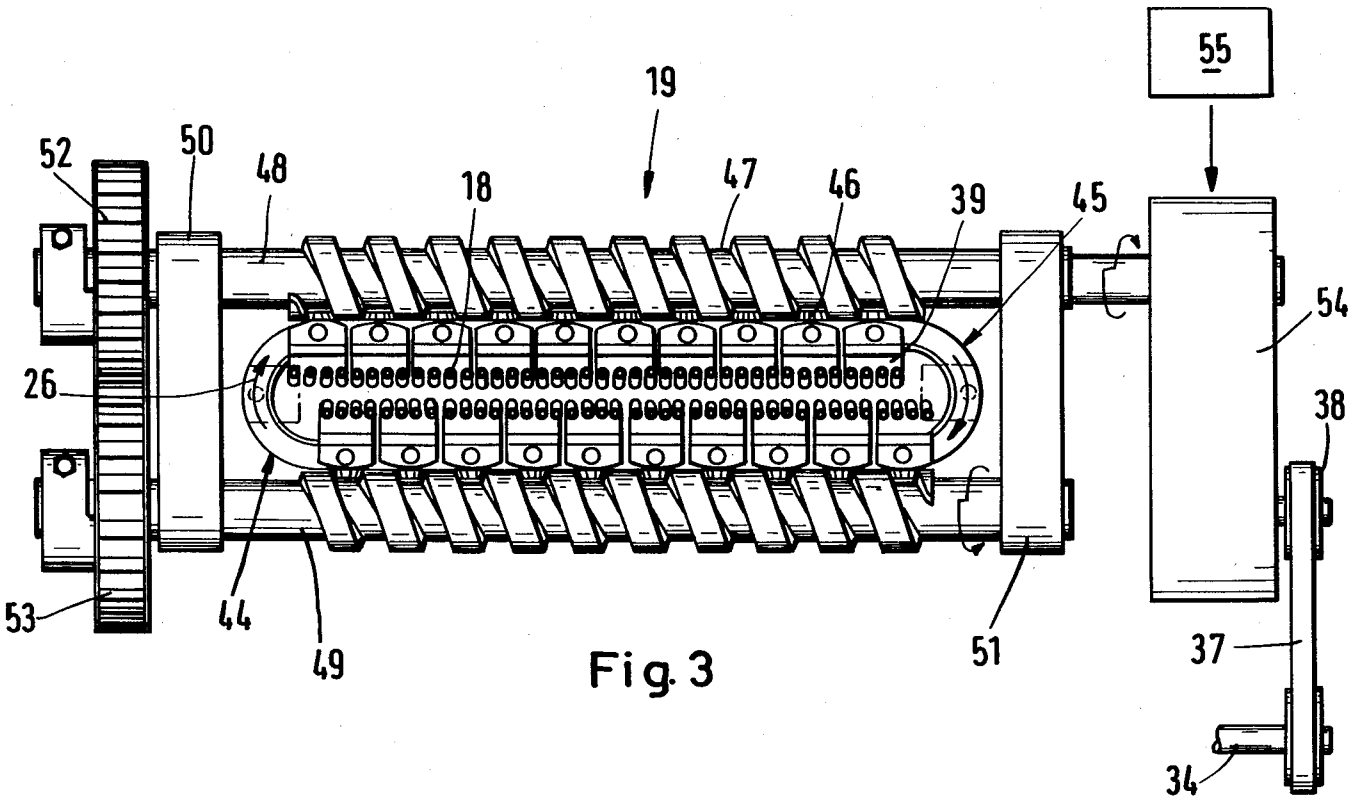
FIG. 3 is a plan view of the lapping arrangment of FIG. 1.

Both of the forwarding helices 48 and 49 (FIG. 3) are journalled in common mounting blocks 50 and 51 and are also coupled together over a pair of gear wheels 52 and 53. The drive operates over a switch gear 54 that can be controlled by a programmable arrangement 55 (for example, a cam driven off the main shaft or a computer timed by the main shaft). As shown the drive for switch gear 54 is previously mentioned drive wheel 38, driven by main shaft 34.

Figure 4:
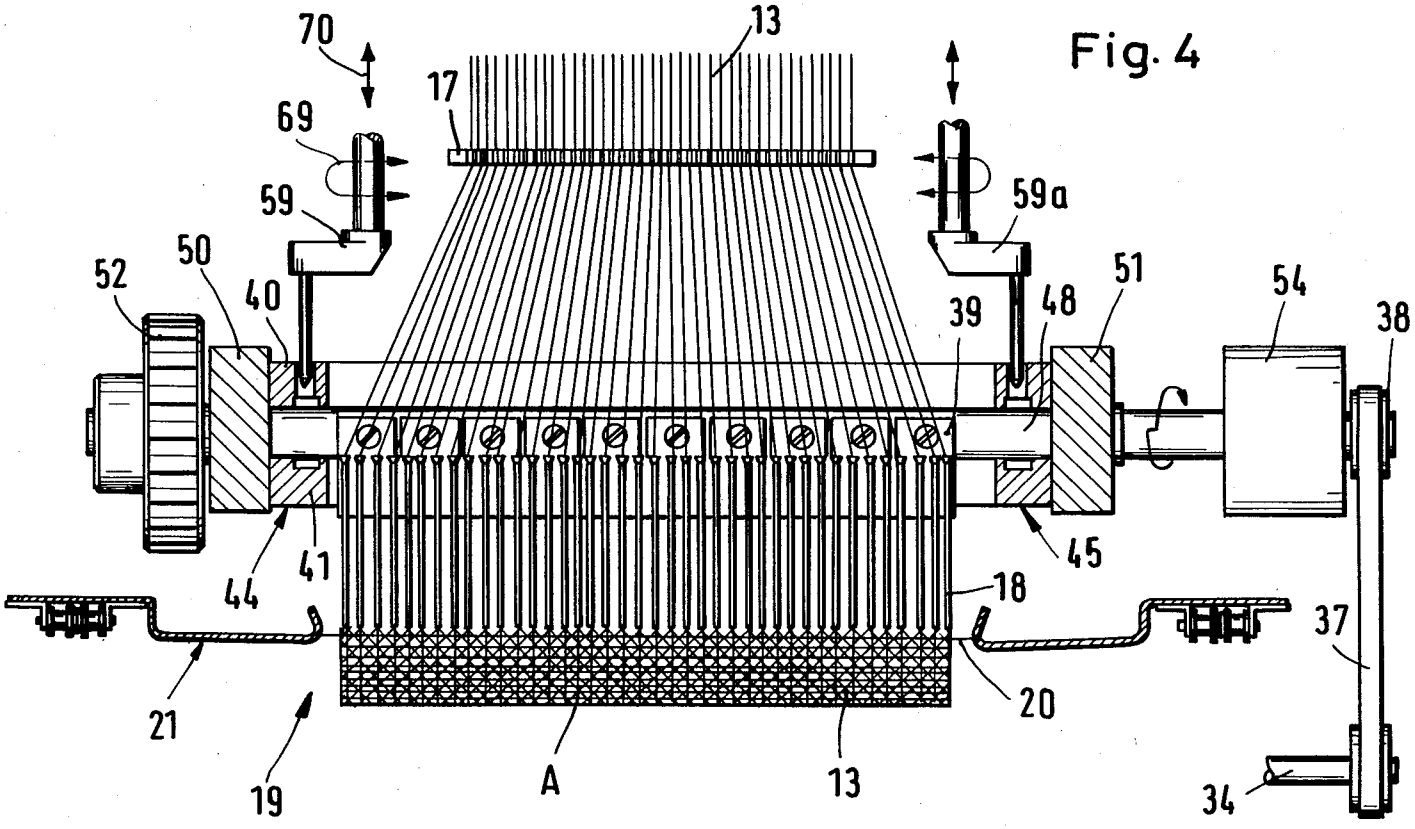
FIG. 4 is a front elevational view of the lapping arrangment of FIG. 1.
Figure 5:
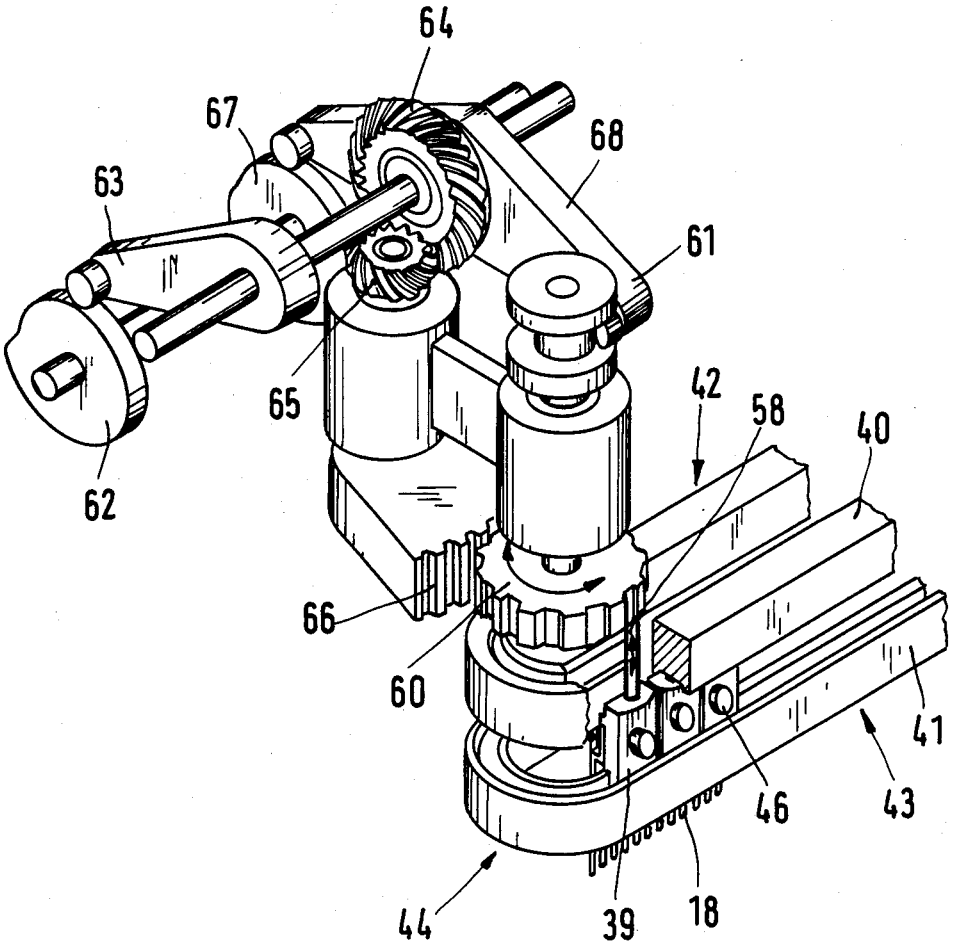
FIG. 5 is a downward perspective view of the lapping arrangement of FIG. 1.

The carriers 39 have a bore 56 in the upper surface thereof to act as a portion of the pin coupling 57 (FIGS. 4, 5 and 6). Into this bore 56 pin 58 of a lifting element 59 can be placed. This lifting element 59 is rotatable by means of gear wheel 60 and may be raised or lowered by lifting finger 61.

The turning drive is operated by cam plate 62, a gear wheel 64 driven by lever 63, a counter gear wheel 65 and a tooth segment 66. Tooth segment engages the teeth of gear wheel 60 to rotate it and pin 58. Lifting movement is achived by a cam plate 67 and a twinned arm lever 68. Reciprocation of arm 68 causes lifting of gear 60 and pin 58. There is thus provided a backwards and forwards turning movement which is indicated by arrow 69 (FIG. 4) and a lifting movement which is indicated by arrow 70. The lifting element 59A at the other turning segment 45 has a corresponding construction.

The drive of the lapping arrangement 19 operates in such a manner that the carriers 39 are carried by forwarding helices 48 and 49 along both parallel segments 42 and 43 of the guide in opposite directions. Significantly, each carrier 39 by virtue of its contact by roller 46 to a side of thread 47 has an exact positioning. This movement can be carried on continuously. However, it desirably proceeds in a step-wise manner in which manner also the movement of the helices 48 and 49 can be predetermined. During the stationary times the needles bar 3 can be caused to run through a single swinging movement so that the needles 3 can be moved through the gaps between the thread guides 18. The step-wise motion thus leads to a displacement in the underlap and/or overlap. Through the rotational movement of the forwarding helices 48 and 49, it is also possible to achieve a rearward displacement.

In the turning segments 44 and 45, pin 58 is inserted into the bore 56 of the pin coupling arrangement 57. By the turning motion of gear wheel 60, carrier 39 is carried to the other forwarding helix where the roller 46 again grips into thread 47. The pin 58 is withdrawn and returns to the starting position of FIG. 5.

In this construction the carriers 39 are moved forward as a consequence of the turning of the helix. Because of the interaction of the roller 46 with the helical threads 47, they may be exactly positioned. Because of the tension supplied by the threads 47, the rollers 46 are caused to lie only on the leading side of the threads 47. Because of the continuous rotation of the rollers 46, however, no undesirable wear occurs. Each carrier 39 is moved independently of its neighboring carrier. All this leads to a high level of positioning of each of the thread guides 18. It is advantageous to provide that the forwarding helices 48, 49 are equivalent to each other and that one of them is driven and the other is carried along by means of a pair of equal gear wheels 52, 53.

It is advantageous, however, if the drive runs over a stepping drive 54. In the nonoperating times it is possible for the needle bar 3 to run through only a single swing movement whereby through a single further turning of the helix 48, 49 a displacement in underlap and/or overlap may occur. Furthermore, it is advantageous to provide that the stepping gear 54 is preprogrammed so that patterning possibilities will arise.

There is thus produced goods A (FIG. 4) comprising warp threads 7 and 8 (FIG. 2 and 4) which run in the take-off direction. Perpendicularly thereto there run the weft threads 20; and diagonally thereto, the warp thread 13. It is possible that at least some of these threads can be made of rigid and, in particular, thick yarn so that goods which are substantially rigid in all directions, (such as is shown in DEOS3304345) are produced. The diagonally running threads 13 can either be just laid into the fabric A or, by use of the needle 3 be bound into stitches.

While in FIG. 6 the roller 46 is shown to have a frustoconical upper surface which fits into the angled sides of the forwarding thread 47, FIG. 7 shows a different embodiment. In this embodiment rollers 46 of the carrier 39 have a cylindrical upper surface for the thread guide 118. Two pins 156 of pin coupling 157 protrude upwardly and downwardly from parallel holes in carrier 139. They interact with appropriate borings (not shown) in the lifting element. At the same time the carrier 139 can be guided with these pins 156.

FIG. 8 shows a carrier 239 which has two coaxial rollers 246 and 246A. The sides of thread 247 has in the vicinity of each roller a recess 271 and 272 so that the rollers can readily rest against the opposite sides and a play-free location is obtained. Essentially these rollers 246, 246A are provided on a single axis in such a manner that in the threads 247, the one side surface of the thread is rearwardly displaced in the area of one roller and the other surface in the area of the other roller.

A rather high level of precision is possible when each carrier 239 is provided with the two rollers 246 and 246A. The roller axis is thus driven from both sides whereby each roller can turn freely.

It will be understood that various changes in the details, materials, arrangement of parts and operating conditions which have been herein described and illustrated in order to explain the nature of the invention, amy be made by those skilled in the art within the principles and scope of the instant invention.

What is claimed is:

1. A thread laying arrangement for a warp knitting machine, comprising:
   - a plurality of circulating carriers each having at least one thread guide and at least one roller;
   - a track having two parallel segments for slidably supporting said circulating carriers and two turning segments connected between and on opposite ends of said parallel segments; and
   - a transport arrangement having a pair of helical driving threads each positioned adjacent a corresponding one of said parallel segments for driving said circulating carriers.

2. An arrangement in accordance with claim 1 wherein the helical driving threads are similar to each other and comprise:
   - a meshed pair of gear wheels each mounted on a corresponding one of said helical driving threads, one of said threads being directly driven and the other being rotated by said meshed pair of gear wheels.

3. An arrangement in accordance with claim 2 wherein said warp knitting machine is driven by a main shaft and wherein the helical driving threads are driven by the main shaft.

4. An arrangement in accordance with claim 3 further comprising:
   - a stepping drive coupled between said main shaft and said transport arrangement, the helical driving threads being driven by the main shaft 32 through said stepping drive.

5. An arrangement in accordance with claim 4 wherein the stepping drive is programmable.

6. An arrangement in accordance with claim 1 wherein the parallel segments of said track each comprise:
   - two guide paths placed above each other for guiding said carriers, the rollers being attached to their carriers between said guide paths.

7. An arrangement in accordance with claim 6 wherein said threads have angled surfaces and wherein the rollers 46 each have a frustro-conical, circumferential surface for engaging the angled sides of said threads.

8. An arrangement in accordance with claim 7 wherein said at least one roller of said carriers comprises:
   - two coaxial rollers, each turn of said threads having opposing sides with radially spaced recesses, one side of said threads being recessed in the location of one of said coaxial rollers, the other side of said threads being recessed in the location of the other roller.

9. An arrangement in accordance with claim 8 wherein the transport arrangement comprises:
   - a pin coupling means for engaging the upper side of said carrier;
   - a turning drive mounted in the area of the turning segments and having a lifting element connecting to the pin coupling means, said lifting element being reciprocatable to activate the pin coupling means and cause the carrier to change direction through turning.

10. An arrangement in accordance with claim 9 wherein said carrier has a bore and wherein said pin coupling means includes:
   - a pin mounted on said lifting element for engaging the bore in said carrier.

11. An arrangement in accordance with claim 9 wherein the pin coupling means comprises:
   - two pins commonly mounted on said carrier to follow the same ones of the guide paths in said track.

12. An arrangement in accordance with claim 6 wherein said warp knitting machine is driven by a main shaft and wherein the helical driving threads are driven by the main shaft.

13. An arrangement in accordance with claim 12 further comprising:
   - a stepping drive coupled between said main shaft and said transport arrangement, the helical driving threads being driven by the main shaft 32 through said stepping drive.

14. An arrangement in accordance with claim 13 wherein the stepping drive is programmable.

* * * * *